US012429260B2

(12) United States Patent
Arnou et al.

(10) Patent No.: US 12,429,260 B2
(45) Date of Patent: Sep. 30, 2025

(54) CONDENSER SUBCOOLER FOR A CHILLER

(71) Applicant: Johnson Controls Tyco IP Holdings LLP, Milwaukee, WI (US)

(72) Inventors: Damien Jean Daniel Arnou, La Séguinière (FR); Francois Charles André Clunet, La Chapelle-sur-Erdre (FR); Paul Eric Le Sausse, Nantes (FR); Laurent Claude Eric Thibaud, Mouzillon (FR)

(73) Assignees: Tyco Fire & Security GmbH, Neuhausen am Rheinfall (CH); Johnson Controls Industries SAS, Carquefou (FR)

( * ) Notice: Subject to any disclaimer, the term of this patent is extended or adjusted under 35 U.S.C. 154(b) by 155 days.

(21) Appl. No.: 18/271,633

(22) PCT Filed: Jan. 11, 2022

(86) PCT No.: PCT/US2022/012005
§ 371 (c)(1),
(2) Date: Jul. 10, 2023

(87) PCT Pub. No.: WO2022/150774
PCT Pub. Date: Jul. 14, 2022

(65) Prior Publication Data

US 2024/0060693 A1 Feb. 22, 2024

Related U.S. Application Data

(60) Provisional application No. 63/136,082, filed on Jan. 11, 2021.

(51) Int. Cl.
*F25B 39/04* (2006.01)
*F25B 40/02* (2006.01)
(Continued)

(52) U.S. Cl.
CPC ..... *F25B 39/04* (2013.01); *F25B 40/02* (2013.01); *F28D 7/163* (2013.01); *F28D 2021/0063* (2013.01)

(58) Field of Classification Search
CPC ..... F25B 39/04; F25B 40/02; F25B 2339/04; F28D 7/163; F28D 2021/0063; F28F 2009/224
See application file for complete search history.

(56) References Cited

U.S. PATENT DOCUMENTS

2010/0242533 A1 9/2010 De Larminat et al.
2014/0034275 A1* 2/2014 Grabon ..... F25B 49/00 165/159

(Continued)

FOREIGN PATENT DOCUMENTS

CN 210035949 U 2/2020
CN 114151996 A * 9/2020 ..... F25B 1/00
JP H08-261601 A 10/1996

OTHER PUBLICATIONS

Pdf is translation of foreign reference CN 114151996 A (Year: 2020).*

(Continued)

*Primary Examiner* — Len Tran
*Assistant Examiner* — Kamran Tavakoldavani
(74) *Attorney, Agent, or Firm* — Fletcher Yoder, PC

(57) ABSTRACT

A condenser includes a shell defining an inner volume configured to receive and discharge a refrigerant, a condensing section disposed within the shell, where the condensing section includes a plurality of tubes configured to circulate cooling fluid therethrough, and a subcooler disposed within the shell and configured to receive the refrigerant from the condensing section. The subcooler includes a first pass having a first set of tubes configured to circulate cooling fluid therethrough, a second pass having a second set of (Continued)

tubes configured to circulate cooling fluid therethrough, where the second pass is disposed downstream of the first pass relative to a flow of refrigerant through the subcooler, and a separation plate disposed between the first set of tubes and the second set of tubes.

20 Claims, 8 Drawing Sheets

(51) Int. Cl.
*F28D 7/16* (2006.01)
*F28D 21/00* (2006.01)

(56) References Cited

U.S. PATENT DOCUMENTS

2015/0007604 A1 1/2015 Hu et al.
2017/0176066 A1* 6/2017 Schreiber ..... F28D 7/1607

OTHER PUBLICATIONS

International Search Report for PCT Application No. PCT/US2022/012005, mailed Apr. 19, 2022, 5 pages.

* cited by examiner

CONDENSER SUBCOOLER FOR A CHILLER

CROSS-REFERENCE TO RELATED APPLICATIONS

This application is a U.S. National Stage Application of International Application No. PCT/US2022/012005, entitled "CONDENSER SUBCOOLER FOR A CHILLER," filed Jan. 11, 2022, which claims priority to and the benefit of U.S. Provisional Application No. 63/136,082, entitled "CONDENSER SUBCOOLER FOR A CHILLER," filed Jan. 11, 2021, each of which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Chiller systems, or vapor compression systems, utilize a working fluid (e.g., a refrigerant) that changes phases between vapor, liquid, and combinations thereof, in response to exposure to different temperatures and pressures within components of the chiller system. A chiller system may place the working fluid in a heat exchange relationship with a conditioning fluid (e.g., water) and may deliver the conditioning fluid to conditioning equipment and/or to a conditioned environment serviced by the chiller system. In such applications, the conditioning fluid may be passed through downstream equipment, such as air handlers, to condition other fluids, such as air in a building.

Traditional chiller systems include a refrigerant circuit having, for example, a compressor, a condenser, and an evaporator. In some condensers, one or more tube bundles may be positioned in a shell or housing of the condenser. Refrigerant vapor may be directed into the shell, and a cooling fluid may be circulated through tubes of the tube bundle to enable heat transfer from the refrigerant to the cooling fluid. The transfer or exchange of heat between the refrigerant vapor and the cooling fluid may cause the refrigerant vapor to condense or change into a liquid phase. Before the refrigerant liquid is discharged from the condenser, the refrigerant liquid may be further cooled (e.g., subcooled) by cooling fluid circulated through an additional tube bundle, which may be referred to as a subcooler, positioned within the shell of the condenser to transfer additional heat from the condensed refrigerant liquid to the cooling fluid. Unfortunately, existing subcooler designs may be complicated and/or expensive to manufacture. Additionally, condensers utilizing existing subcooler designs may demand increased levels of refrigerant.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a condenser includes a shell defining an inner volume configured to receive and discharge a refrigerant, a condensing section disposed within the shell, where the condensing section includes a plurality of tubes configured to circulate cooling fluid therethrough, and a subcooler disposed within the shell and configured to receive the refrigerant from the condensing section. The subcooler includes a first pass having a first set of tubes configured to circulate cooling fluid therethrough, a second pass having a second set of tubes configured to circulate cooling fluid therethrough, where the second pass is disposed downstream of the first pass relative to a flow of refrigerant through the subcooler, and a separation plate disposed between the first set of tubes and the second set of tubes.

In another embodiment, a condenser for a heating, ventilation, air conditioning, and refrigeration (HVAC&R) system includes a shell configured to receive vapor refrigerant. The condenser also includes a condensing section disposed within the shell, where the condensing section has a plurality of tubes configured to circulate cooling fluid therethrough, and the condensing section is configured to condense the vapor refrigerant to form liquid refrigerant. The condenser further includes a subcooler disposed within the shell downstream of the condensing section relative to refrigerant flow through the condenser. The subcooler includes a first pass configured to receive the liquid refrigerant from the condensing section, a second pass configured to receive the liquid refrigerant from the first pass, and a separation plate extending along a length of the condenser, where the separation plate divides the first pass and the second pass, and the separation plate is configured to direct the liquid refrigerant along the first pass to the second pass.

In a further embodiment, a condenser for a heating, ventilation, air conditioning, and refrigeration (HVAC&R) system includes a shell configured to receive and discharge a refrigerant and a plurality of tubes disposed within the shell and configured to place the refrigerant in a heat exchange relationship with cooling fluid directed through the plurality of tubes to condense the refrigerant. The condenser also includes a subcooler disposed within the shell, where the subcooler includes a first pass having a first set of tubes disposed beneath the plurality of tubes and configured to direct cooling fluid therethrough, a second pass having a second set of tubes disposed beneath the first set of tubes and configured to direct cooling fluid therethrough, a separation plate disposed between the first set of tubes and the second set of tubes to divide the first pass and the second pass, and a baffle disposed within the second pass, where the baffle is configured to support the second set of tubes.

BRIEF DESCRIPTION OF THE DRAWINGS

Various aspects of this disclosure may be better understood upon reading the following detailed description and upon reference to the drawings in which.

DETAILED DESCRIPTION

Figure 1:
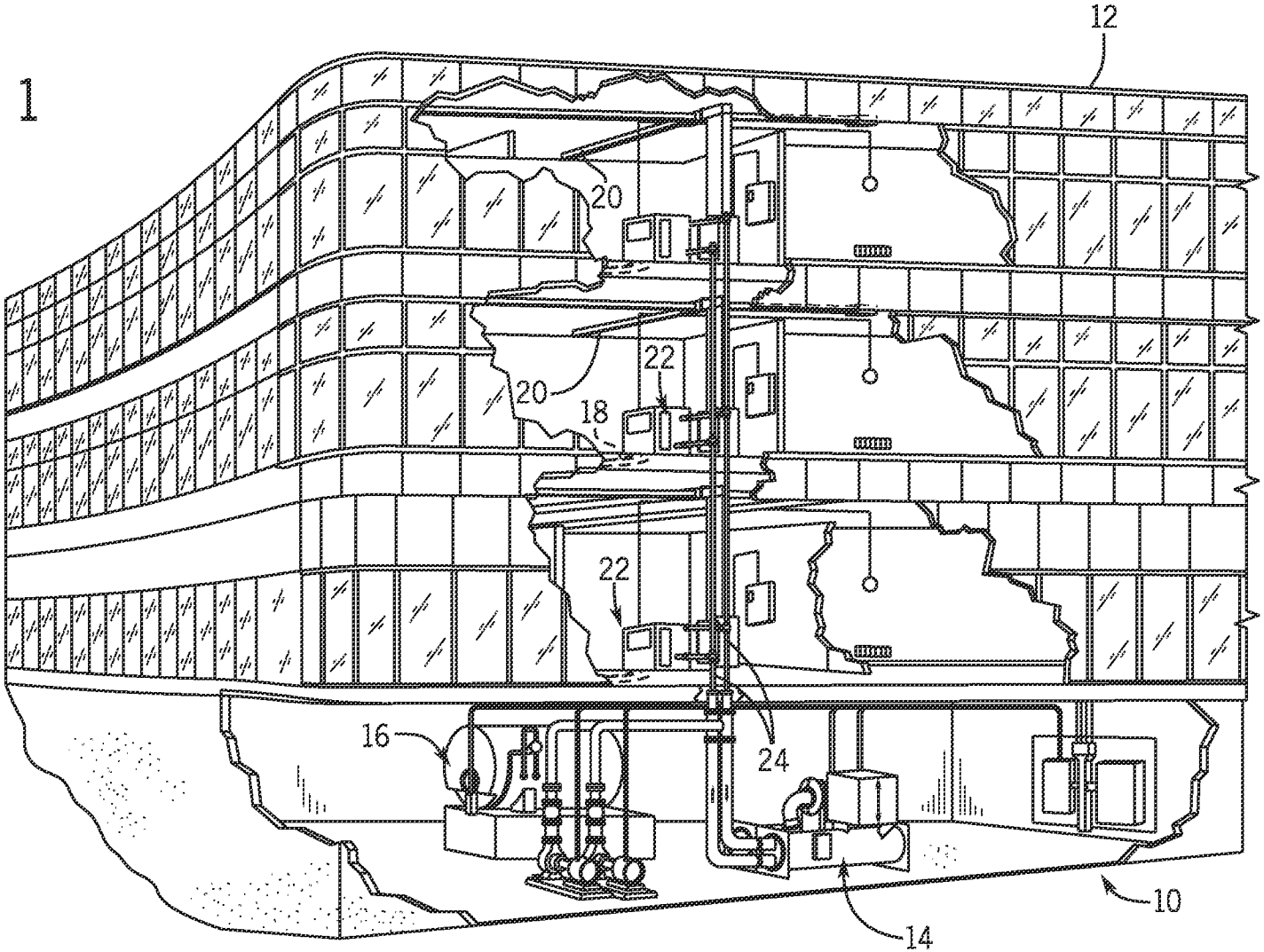
FIG. 1 is a perspective view of an embodiment of a building that may utilize a heating, ventilating, air conditioning, and refrigeration (HVAC&R) system in a commercial setting, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure related to a heating, ventilation, air conditioning, and refrigeration (HVAC&R) system, such as a chiller system. The HVAC&R system may include a vapor compression system (e.g., vapor compression circuit) through which a refrigerant (e.g., a working fluid) is directed in order to heat and/or cool a conditioning fluid. As an example, the vapor compression system may include a compressor configured to pressurize the refrigerant and to direct the pressurized refrigerant to a condenser configured to cool and condense the pressurized refrigerant. An evaporator of the vapor compression system may receive the cooled, condensed refrigerant and may place the cooled, condensed refrigerant in a heat exchange relationship with the conditioning fluid to absorb thermal energy or heat from the conditioning fluid, thereby cooling the conditioning fluid. The cooled conditioning fluid may then be directed to conditioning equipment, such as air handlers and/or terminal units, for use in conditioning air supplied to a building or other conditioned space.

In general, the condenser is configured to cool the pressurized refrigerant by placing the pressurized refrigerant in a heat exchange relationship with a cooling fluid, such as air or water. For example, the condenser may have a shell or housing defining an inner volume configured to receive the pressurized refrigerant from the compressor, and the condenser may include a plurality of tubes (e.g., a tube bundle) disposed within the inner volume of the shell. The plurality of tubes is configured to circulate the cooling fluid (e.g., water) through the plurality of tubes to enable heat transfer from the pressurized refrigerant to the cooling fluid. In some embodiments, the condenser may include a subcooler (e.g., an integrated subcooler) configured to further cool (e.g., subcool) the refrigerant once it has condensed within the condenser (e.g., via heat exchange with the cooling fluid directed through the plurality of tubes). For example, the condenser may include an additional plurality of tubes (e.g., an additional tube bundle) disposed within the shell and configured to circulate cooling fluid to further cool the refrigerant. Unfortunately, existing subcooler designs may be complicated and/or expensive to manufacture. Existing sub cooler designs may also demand the use of increased amounts or levels of refrigerant.

Accordingly, present embodiments are directed to a subcooler for a condenser that is cost effective to manufacture and implement in condensers while providing desirable operational efficiency. The disclosed systems and techniques also enable a reduction in refrigerant charge utilized with vapor compression systems, including chillers. For example, a subcooler in accordance with the present techniques includes tubes disposed within a shell of a condenser that are separated into a first pass and a second pass (e.g., relative to a flow of refrigerant across or along the tubes). That is, the first pass of the subcooler may include a first tube bundle (e.g., a first set of tubes), and the second pass of the subcooler may include a second tube bundle (e.g., a second set of tubes). The first and second passes of the subcooler are at least partially divided by a separation plate disposed within the shell of the condenser, where the first pass is above the separation plate, and the second pass is below the separation plate (e.g., relative to gravity).

The tubes of the subcooler (e.g., the first and second passes or subsets of tubes) are supported within the shell of the condenser by tube sheets (e.g., baffles) of the condenser and/or by baffles or tube supports of the subcooler. In other words, the tubes of the subcooler may extend through holes or apertures of one or more of the tube sheets and baffles, such that the tubes are suspended within the shell. The tube sheets and baffles may also include additional holes and apertures in which tubes of the subcooler are not disposed. Thus, refrigerant flowing through the subcooler may flow through the holes of the tube sheets and/or baffles that are not occupied by tubes of the subcooler. In this way, a localized flow rate of refrigerant may be increased at the tube sheets and baffles, which promotes additional heat transfer between the refrigerant and the cooling fluid. The number and configuration of the baffles may be selected to achieve a desired reduction in refrigerant volume and/or a desired pressure drop of the refrigerant in the condenser. Additional features of the subcooler configurations described herein are discussed below.

Turning now to the drawings, FIG. 1 is a perspective view of an embodiment of an environment for a heating, ventilation, air conditioning, and refrigeration (HVAC&R) system 10 in a building 12 for a typical commercial setting. The HVAC&R system 10 may include a vapor compression system 14 (e.g., a chiller, a vapor compression circuit, a refrigerant circuit) that supplies a chilled liquid, which may be used to cool the building 12. The HVAC&R system 10 may also include a boiler 16 to supply warm liquid to heat the building 12 and an air distribution system which circulates air through the building 12. The air distribution system may also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler 22 on each floor of the building 12, but in other embodiments, the HVAC&R system 10 may include air handlers 22 and/or other components that may be shared between or among floors.

Figure 2:
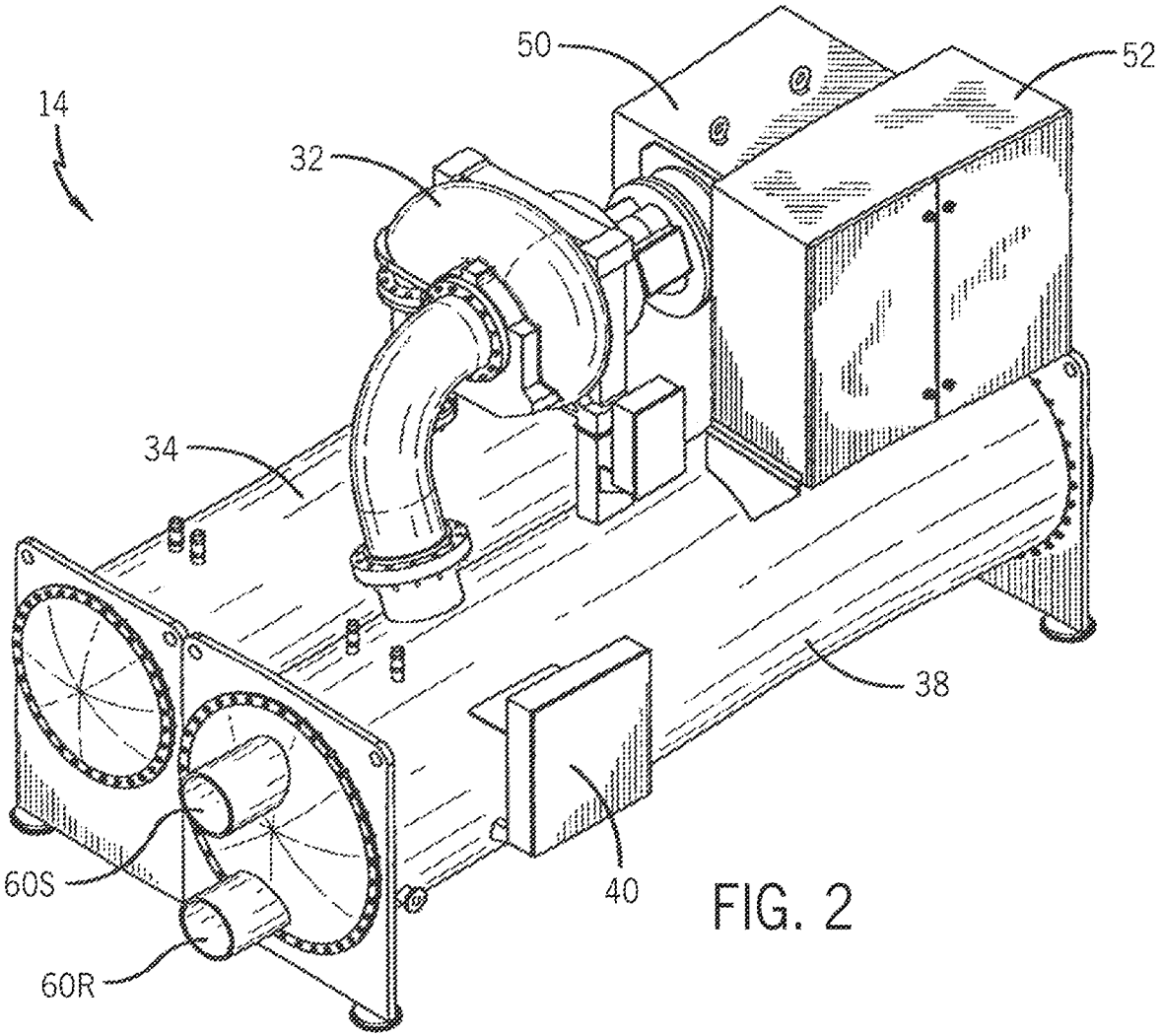
FIG. 2 is a perspective view of an embodiment of a vapor compression system, in accordance with an aspect of the present disclosure.
Figure 3:
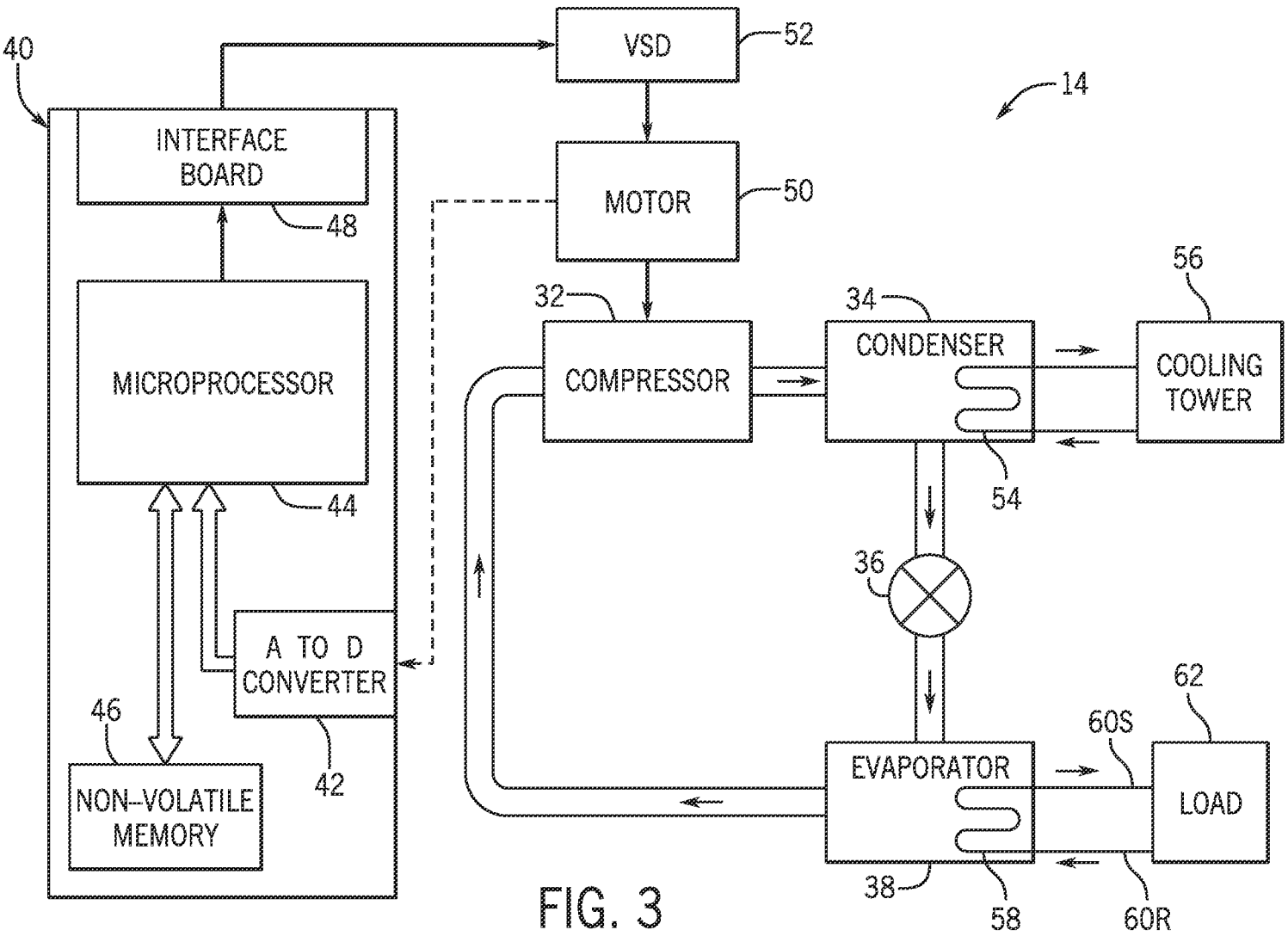
FIG. 3 is a schematic of an embodiment of the vapor compression system of FIG. 2, in accordance with an aspect of the present disclosure.

FIGS. 2 and 3 illustrate embodiments of the vapor compression system 14 that can be used in the HVAC&R system 10. Specifically, FIG. 2 shows a perspective view of the vapor compression system 14, and FIG. 3 shows a schematic of the vapor compression system 14. The vapor compression system 14 may circulate a refrigerant through a circuit starting with a compressor 32. The circuit may also include a condenser 34, an expansion valve(s) or device(s) 36, and an evaporator 38. The vapor compression system 14 may further include a control panel 40 that has an analog to digital (A/D) converter 42, a microprocessor 44, a non-volatile memory 46, and/or an interface board 48.

Some examples of fluids that may be used as refrigerants in the vapor compression system 14 are hydrofluorocarbon (HFC) based refrigerants, for example, R-410A, R-407, R-134a, hydrofluoro olefin (HFO), "natural" refrigerants like ammonia ($NH_3$), R-717, carbon dioxide (CO2), R-744, or hydrocarbon based refrigerants, water vapor, or any other suitable refrigerant. In some embodiments, the vapor compression system 14 may be configured to efficiently utilize refrigerants having a normal boiling point of about 19 degrees Celsius (66 degrees Fahrenheit) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The liquid refrigerant from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser 34.

The liquid refrigerant delivered to the evaporator 38 may absorb heat from another cooling fluid (e.g., a conditioning fluid), which may or may not be the same cooling fluid circulated through the condenser 34. The liquid refrigerant in the evaporator 38 may undergo a phase change from the liquid refrigerant to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the vapor refrigerant exits the evaporator 38 and returns to the compressor 32 by a suction line to complete the cycle of the vapor compression system 14.

Figure 4:
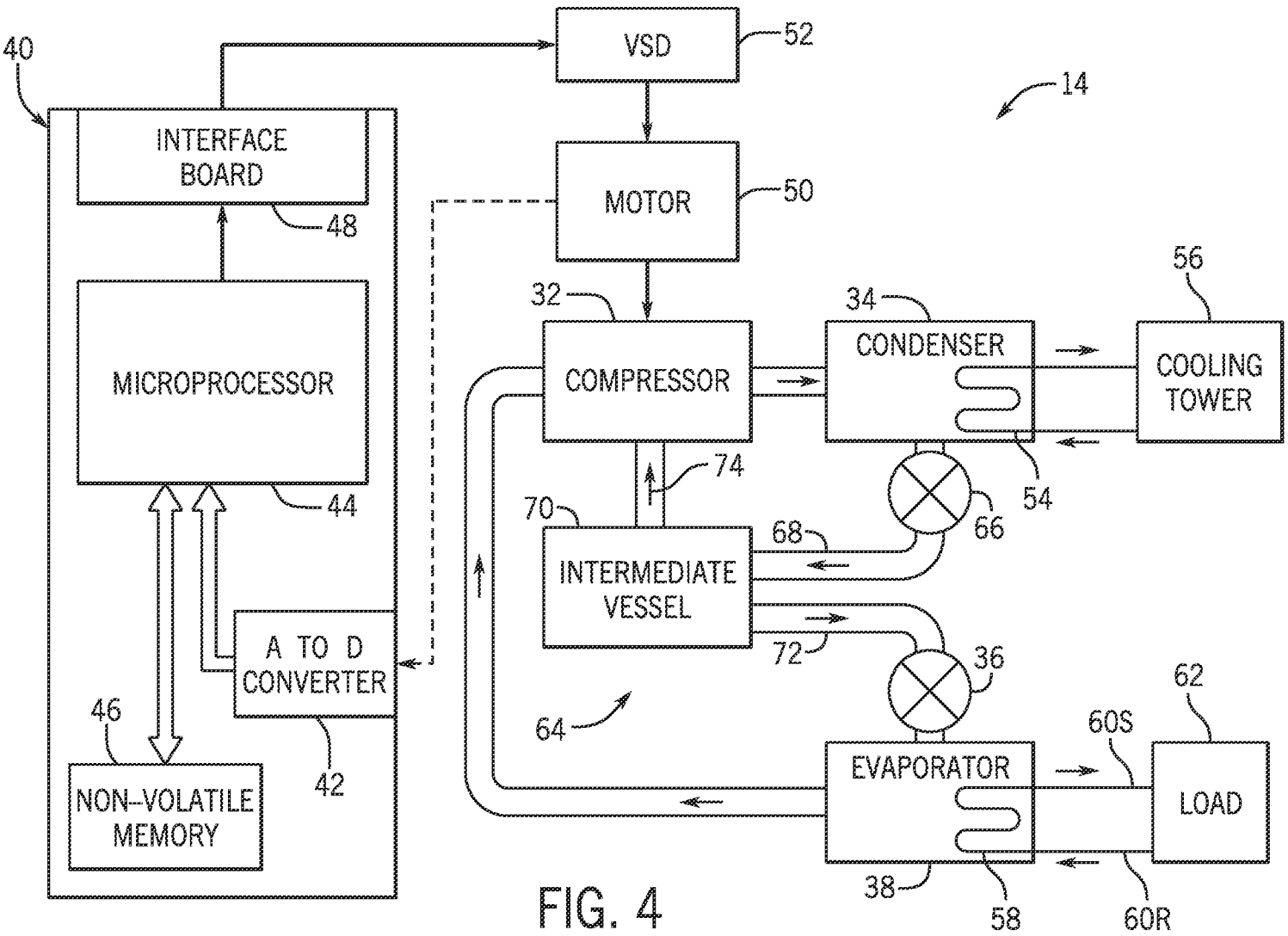
FIG. 4 is a schematic of an embodiment of the vapor compression system of FIG. 2, in accordance with an aspect of the present disclosure.

FIG. 4 is a schematic of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the liquid refrigerant received from the condenser 34. During the expansion process, a portion of the liquid may vaporize, and thus, the intermediate vessel 70 may be used to separate the vapor from the liquid received from the first expansion device 66.

Additionally, the intermediate vessel 70 may provide for further expansion of the liquid refrigerant because of a pressure drop experienced by the liquid refrigerant when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the liquid refrigerant exiting the condenser 34 due to expansion in the expansion device 66 and/or the intermediate vessel 70. The liquid from intermediate vessel 70 may then flow in line 72 through a second expansion device 36 to the evaporator 38.

It should be appreciated that any of the features described herein may be incorporated with the vapor compression system 14 or any other suitable HVAC&R system. As mentioned above, embodiments of the present disclosure are directed to a subcooler that may be utilized with the condenser 34 of the vapor compression system 14. For example, the subcooler may be integrated within the condenser 34. Embodiments of the subcooler disclosed herein may be manufactured with cost effective components and techniques while providing desirable levels of refrigerant subcooling. For example, a subcooler in accordance with the present disclosure includes a plurality of tubes divided into a first pass (e.g., a first set of tubes) and a second pass (e.g., a second set of tubes). The first pass and the second pass define two portions (e.g., passes) of a refrigerant flow path through the subcooler. The first and second passes of tubes are at least partially divided by a separation plate. The separation plate guides and improves refrigerant flow through the condenser 34 (e.g., the subcooler) along the first pass, from the first pass to the second pass, and along the second pass to enhance subcooling of the refrigerant within the condenser 34. Additionally, the condenser 34 and/or subcooler includes baffles that are arrayed along the first pass and/or the second pass. The baffles may include holes or openings that may be utilized to support the tubes of the subcooler and/or to adjust (e.g., control, modify, etc.) flow of the refrigerant through the condenser 34 (e.g., the subcooler), which may improve heat transfer from the cooling fluid to the refrigerant.

Figure 5:
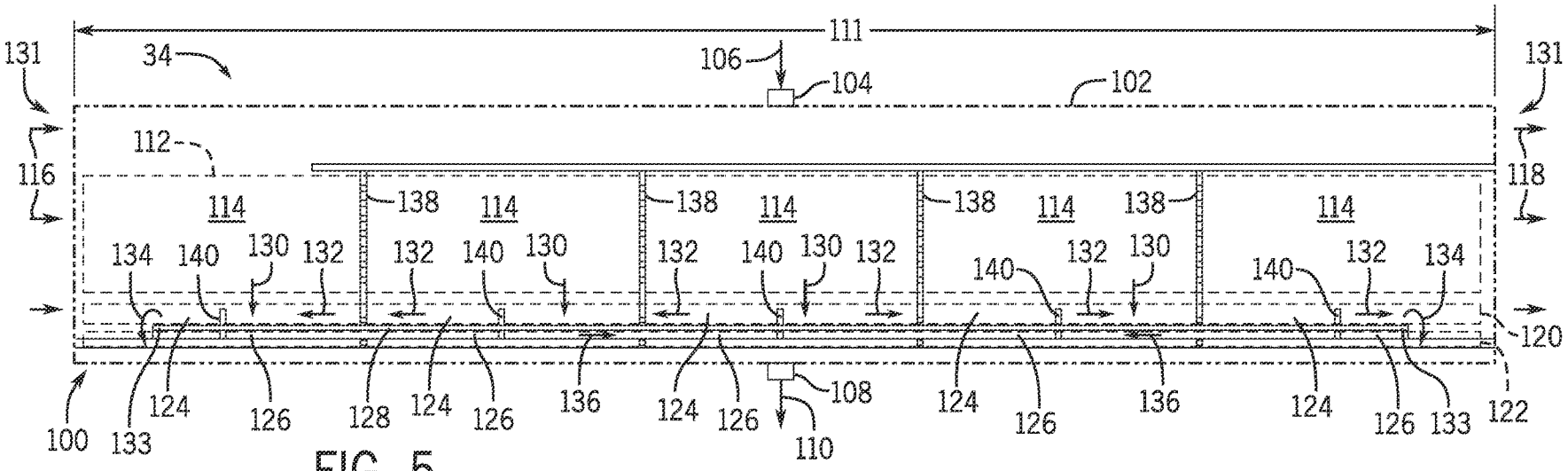
FIG. 5 is a cross-sectional side view schematic of an embodiment of a condenser having a subcooler, in accordance with an aspect of the present disclosure.

With the foregoing in mind, FIG. 5 is a cross-sectional side view schematic of an embodiment of the condenser 34 having a subcooler 100 (e.g., subcooler arrangement, integrated subcooler, etc.), in accordance with aspects of the present disclosure. The condenser 34 also includes a shell 102 in which a plurality of tubes configured to circulate a cooling fluid (e.g., water) may be disposed. The shell 102 defines an inner volume and includes an inlet 104 configured to receive pressurized refrigerant (e.g., vapor refrigerant) from the compressor 32, as indicated by arrow 106. The shell 102 also includes an outlet 108 configured to discharge refrigerant (e.g., cooled, condensed refrigerant) toward the expansion device 36, as indicated by arrow 110. As shown, the inlet 104 and the outlet 108 may be positioned generally at a midpoint along a length 111 of the condenser 34.

Within the condenser 34, the pressurized refrigerant is cooled and condensed via heat exchange with a cooling fluid (e.g., water) circulated through the plurality of tubes disposed within the shell 102. For example, the condenser 34 may include a condensing section 112 having a tube bundle 114 (e.g., a plurality of tubes, a set of tubes, etc.) extending along the length 111 of the condenser 34 and configured to direct cooling fluid therethrough. Specifically, as indicated by arrows 116, cooling fluid from a cooling fluid source is directed into the shell 102 of the condenser 102, and at least of portion of the cooling fluid may be directed through the tube bundle 114 of the condensing section 112. The pressurized refrigerant is directed across (e.g., over) the tube bundle 114 within the shell 102 and is condensed via heat exchange with the cooling fluid flowing through the tube bundle 114. Warm cooling fluid is discharged from the condenser 34, as indicated by arrows 118, and may be directed back to the cooling fluid source.

The subcooler 100 of the condenser 34 also receives cooling fluid from the cooling fluid source for heat exchange with the refrigerant within the shell 102. More specifically, the subcooler 100 may include one or more tube bundles (e.g., sets of tubes), separate from the tube bundle 114 of the condensing section 112, and the tube bundles of the subcooler 100 circulate cooling fluid therethrough to exchange heat with the refrigerant (e.g., after the refrigerant exchanges heat with the cooling fluid directed through the tube bundle 114 of the condensing section 112). In the illustrated embodiment, the subcooler 100 includes a first pass 120 (e.g., an open pass, a first refrigerant pass) and a second pass 122 (e.g., a closed pass, a second refrigerant pass). The first pass 120 includes a first tube bundle 124 (e.g., a first set of tubes), and the second pass 122 includes a second tube bundle 126 (e.g., a second set of tubes). It should be noted that the tube bundle 114, the first tube bundle 124, and the second tube bundle 126 are illustrated schematically for clarity, and it should be understood that each of the tube bundle 114, the first tube bundle 124, and the second tube bundle 126 includes a plurality of tubes extending through the shell 102 and configured to direct a respective flow of cooling fluid therethrough.

Similar to the tube bundle 114 of the condensing section 112, the first tube bundle 124 and the second tube bundle 126 of the subcooler 100 also extend along the length 111 of the condenser 34 and are configured to direct the cooling fluid therethrough. It should be noted that, while the illustrated embodiment includes tube bundles 114, 124, and 126 that direct the cooling fluid through the condenser 34 in a single pass of the cooling fluid through the condenser 34, other embodiments of the condenser 34 may include tube bundles configured to (e.g., individually, cooperatively) direct the cooling fluid along multiple passes of the condenser 34. In other words, the tube bundles of the condensing section 112, the first pass 120, and/or the second pass 122 may individually or cooperatively direct the cooling fluid along the length 111 of the condenser 34 multiple times (e.g., multiple passes) instead of along the length 111 of the condenser 34 a single time (e.g., a single pass) as in the illustrated embodiment.

As shown, the first pass 120 and the second pass 122 of the subcooler 100 are at least partially separated by a separation plate 128 disposed within the shell 102. The separation plate 128 may be a solid plate (e.g., metallic plate) that extends along the length 111 of the condenser 34 and at least partially defines a flow path of refrigerant within the shell 102 along the first pass 120, from the first pass 120 to the second pass 122, and along the second pass 122 to the outlet 108 of the condenser 34. In other words, the first pass 120 is disposed downstream of the condensing section 112, relative to a direction of refrigerant flow through the condenser 34, and the second pass 122 is disposed downstream of the first pass 120. For example, condensed refrigerant from the condensing section 112 may travel to the first pass 120 of the subcooler 100, as indicated by arrows 130. The condensed refrigerant may then contact the separation plate 128 and be directed to flow along the first pass 120 (e.g., along the first tube bundle 124) towards axial or longitudinal ends 131 of the condenser 34, as indicated by arrows 132. As the refrigerant flows along the first pass 120 and the separation plate 128, the temperature of the refrigerant may be further reduced (e.g., subcooled) via heat exchange with cooling fluid flowing through the first tube bundle 124.

At longitudinal ends 133 of the separation plate 128, the refrigerant may flow to the second pass 122 of the subcooler 100, as indicated by arrows 134. In other words, the separation plate 128 may not extend the entire length 111 of the condenser 34, such that the longitudinal ends 133 of the separation plate 128 are offset from the longitudinal ends of the condenser 34 (e.g., the shell 102). In this way, the condenser 34 (e.g., the subcooler 100) enables refrigerant flow from the first pass 120 to the second pass 122 proximate the longitudinal ends 131 of the condenser 34. Thereafter, the refrigerant may flow through the second pass 122 and along the second tube bundle 126 (e.g., between the separation plate 128 and the shell 102), as indicated by arrows 136, until the refrigerant reaches the outlet 108 (e.g., at or near a midpoint of the length 111 of the condenser 34) and is discharged from the condenser 34. As the refrigerant flows through the second pass 122, the refrigerant may be further cooled (e.g., subcooled) via heat exchange with cooling fluid flowing through the second tube bundle 126.

As noted above, the first pass 120 of the subcooler 100 is disposed above the separation plate 128 (e.g., relative to gravity). Thus, the first pass 120 is "open" and is exposed to the condensing section 112. In other words, a refrigerant flow path from the condensing section 112 to the first pass 120 is "open" such that refrigerant may generally flow freely and unobstructed from the condensing section 112 to the first pass 120. As a result, the first pass 120 (e.g., the first tube bundle 124) may receive refrigerant from (e.g., directly from) the condensing section 112 via force of gravity. In some embodiments, a refrigerant charge or level of the condenser 34 may be selected or controlled such that refrigerant flowing from the first pass 120 to the second pass 122 is a completely or substantially completely condensed liquid. In this way, all tubes of the second tube bundle 126 may be submerged in liquid refrigerant, which may improve subcooling of the liquid refrigerant due to increased contact between the liquid refrigerant and each tube of the second tube bundle 126 in the second pass 122.

In some embodiments, at least a portion of the first tube bundle 124 may also be submerged in condensed (e.g., liquid) refrigerant flowing along the first pass 120, thereby further improving subcooling of the refrigerant within the condenser 34. The number of tubes in the first tube bundle 124 may be selected based on a desired or expected refrigerant volume within the condenser 34 and/or amount of subcooling provided to the refrigerant by the condenser 34. The number of tubes in the second tube bundle 126 of the second pass 122, in some embodiments, may be selected based on a desired amount of pressure drop of the refrigerant in the condenser 34 (e.g., in the second pass 122). Further, in certain embodiments, the tubes of the first tube bundle 124 and/or the tubes of the second tube bundle 126 may be "bare" tubes (e.g., tubes without fins). In some embodiments, there may be little or substantially no space (e.g., in a generally vertical direction of FIG. 5) between the first pass 120 and the condensing section 112 in order to reduce an overall size of the condenser 34 (e.g., provide a more compact arrangement of the tube bundle 114 and the first tube bundle 124). In other words, the tube bundle 114 of the condensing section 112 may be positioned more proximate than the first tube bundle 124 of the first pass 120 compared to traditional condensers with subcoolers. The amount of space between the first pass 120 and the condensing section 112 may additionally or alternatively be based on an amount of refrigerant charge and/or a refrigerant level selected for the condenser 34.

Furthermore, embodiments of the subcooler 100 disclosed herein are configured to be manufactured in a cost effective manner. For example, components of the subcooler 100 may be relatively inexpensive to produce and/or may be assembled with reduced complexity. As previously discussed, the subcooler 100 includes the first tube bundle 124, the second tube bundle 126, and the separation plate 128 disposed therebetween. Additional components utilized with the subcooler 100 include tube sheets 138 of the condenser 34. As will be appreciated, the tube sheets 138 are configured to support tubes of the tube bundle 114 of the condensing section 112, such that the tube bundle 114 is suspended within the shell 102 of the condenser 34 (e.g., above the subcooler 100). More specifically, the tube sheets 138 are arrayed or spaced along the length 111 of the condenser 36 and include holes or apertures through which tubes of the tube bundle 114 extend. The tube sheets 138 may also support tubes of the first tube bundle 124 and/or the second tube bundle 126 of the subcooler 100 via holes or apertures of the tube sheets 138. The tube sheets 138 may further include additional holes or apertures that do not support tubes of the first tube bundle 124 and/or the second tube bundle 126 of the subcooler 100. That is, the tubes sheets 138 may have one or more holes or apertures that are disposed along first pass 120 and/or the second pass 122 of the subcooler 100 but are not occupied by tubes of the first tube bundle 124 and/or the second tube bundle 126 of the subcooler 100. Instead, the unoccupied holes of the tube sheets 138 may function to improve flow of refrigerant along the first pass 120 and/or the second pass 122, for example, by increasing a localized velocity of the refrigerant, improving longitudinal flow of refrigerant within the subcooler 100 (e.g., along directions 132 and/or 134), and/or reducing pressure loss of the refrigerant in the condenser 34 (e.g., subcooler 100).

The subcooler 100 also includes baffles 140 (e.g., tube supports) arrayed along the length 111 of the condenser 34. As shown, the baffles 140 are arrayed along the length 111 of the condenser 34 and may be positioned in an alternating arrangement with the tube sheets 138 (e.g., along the length 111). The baffles 140 are configured to support tubes of the first tube bundle 124 and/or tubes of the second tube bundle 126. For example, each baffle 140 may support approximately half of the tubes in the first tube bundle 124, half of the tubes in the second tube bundle 126, or both. The baffles 140 may also be configured to increase a localized velocity of the refrigerant and/or reduce pressure loss of the refrigerant in the condenser 34. Specifically, as similarly described above, the baffles 140 include holes or apertures that may support one of the tubes of the first tube bundle 124 or the second tube bundle 126. The baffles 140 may also include holes or apertures that are unoccupied by tubes of the first tube bundle 124 or the second tube bundle 126 and instead function to improve refrigerant flow through the subcooler 100, such as by increasing a localized velocity of the refrigerant and/or by improving flow of the refrigerant longitudinally along the length 111 of the condenser 34. In some embodiments, a number of the baffles 140 included in the subcooler 100 may be selected to achieve a desired pressure drop of the refrigerant in the first pass 120, the second pass 122, or both. Additional details of the baffles 140 are described below.

Figure 6:
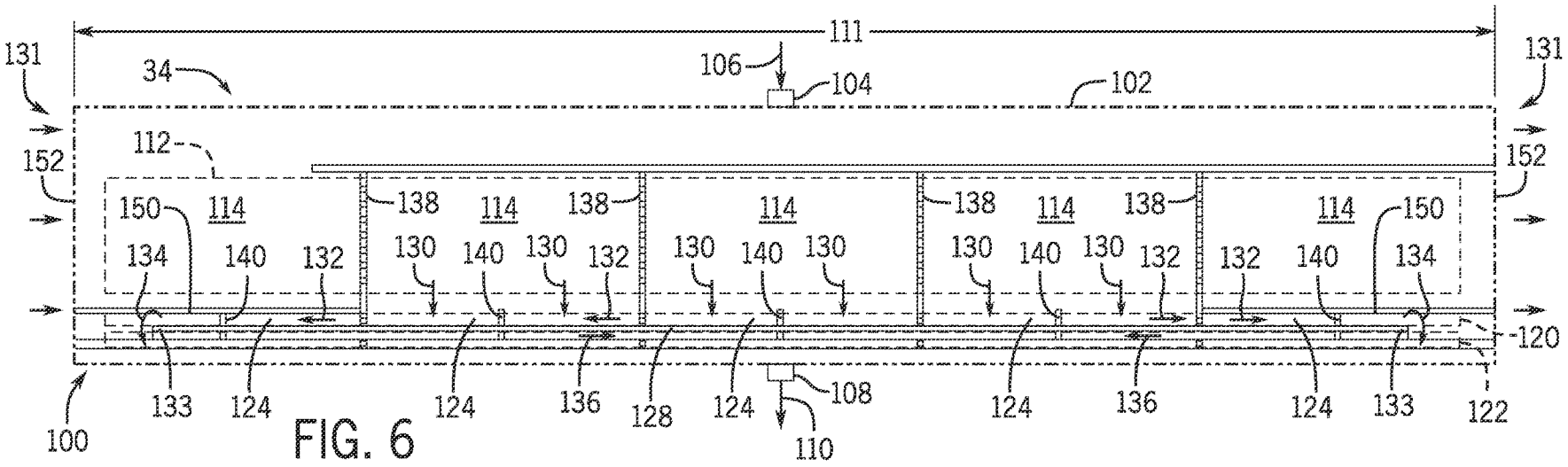
FIG. 6 is a cross-sectional side view schematic of an embodiment of a condenser having a subcooler, in accordance with an aspect of the present disclosure.

FIG. 6 is a cross-sectional side view schematic of an embodiment of the condenser 34 having the subcooler 100. The embodiment illustrated in FIG. 6 includes similar elements and element numbers as the embodiment shown in FIG. 5. Additionally, the illustrated embodiment of the condenser 34 (e.g., subcooler 100) includes end panels 150 (e.g., end sheets, quarter sheets, etc.) disposed at the longitudinal ends 131 of the condenser 34. In some embodiments, the end panels 150 may be coupled to axial ends (e.g., axial end surfaces, axial end panels, etc.) 152 of the shell 102, but in other embodiments the end panels 150 may be offset from the axial ends 152. The end panels 150 extend from the axial ends 152 of the shell 102 and along the length 111 of the condenser toward a center of the condenser 34. In some embodiments, the end panels 150 may improve a stiffness and/or structural rigidity of the condenser 34. The end panels 150 are disposed generally above (e.g., relative to gravity) the first pass 120 (e.g., the first tube bundle 124) of the subcooler 100. The end panels 150 may also be disposed below (e.g., relative to gravity) the condensing section 112 (e.g., the tube bundle 114). For example, as shown in FIG. 6, each end panel 150 extends from one of the axial ends 152 to one of the tube sheets 138 of the condenser 34 and/or may abut one of the tube sheets 138. However, in other embodiments, the end panels 150 may not contact or abut the tube sheets 138.

The end panels 150 may further improve subcooling of refrigerant flowing through the subcooler 100 (e.g., along the first pass 120). For example, the end panels 150 enable separation of a flow of subcooled or partially subcooled refrigerant from a flow of refrigerant that is not subcooled, such as by limiting flow of non-subcooled refrigerant toward ends (e.g., the longitudinal ends 133) of the separation plate 128. In this way, axial ends of the first tube bundle 124 may be more completely submerged by refrigerant, which further improves subcooling of the refrigerant. For example, refrigerant may flow across or over the tube bundle 114 of the condensing section 112 and may flow toward the first tube bundle 124 of the first pass 120 of the subcooler 100. While some refrigerant may flow from the condensing section 112 to contact the separation plate 128 (e.g., flow directly from the condensing section 112 to the first pass 120), some refrigerant (e.g., proximate the longitudinal ends 131 of the condenser 34) may flow from the condensing section 112 to contact one of the end panels 150. The end panels 150 may direct the refrigerant toward a center of the length 111 of the condenser 34, such that the refrigerant is then directed onto the separation plate 128 and into the first pass 120 of the subcooler 100 away from the longitudinal ends 131 of the condenser 34. Thereafter, the refrigerant may flow along the first pass 120 (e.g., in directions 132, between the end panel 150 and the separation plate 128). In this way, the end panels 150 may block refrigerant (e.g., non-subcooled refrigerant) from bypassing or substantially bypassing the first pass 120 of the subcooler 100 at the longitudinal ends 131 of the condenser 34, which may further improve subcooling of the refrigerant (e.g., via the first pass 120 of the subcooler 100). The end panels 150 may also enable more even distribution of refrigerant flow across or along the length 111 of the condenser 34.

Figure 7:
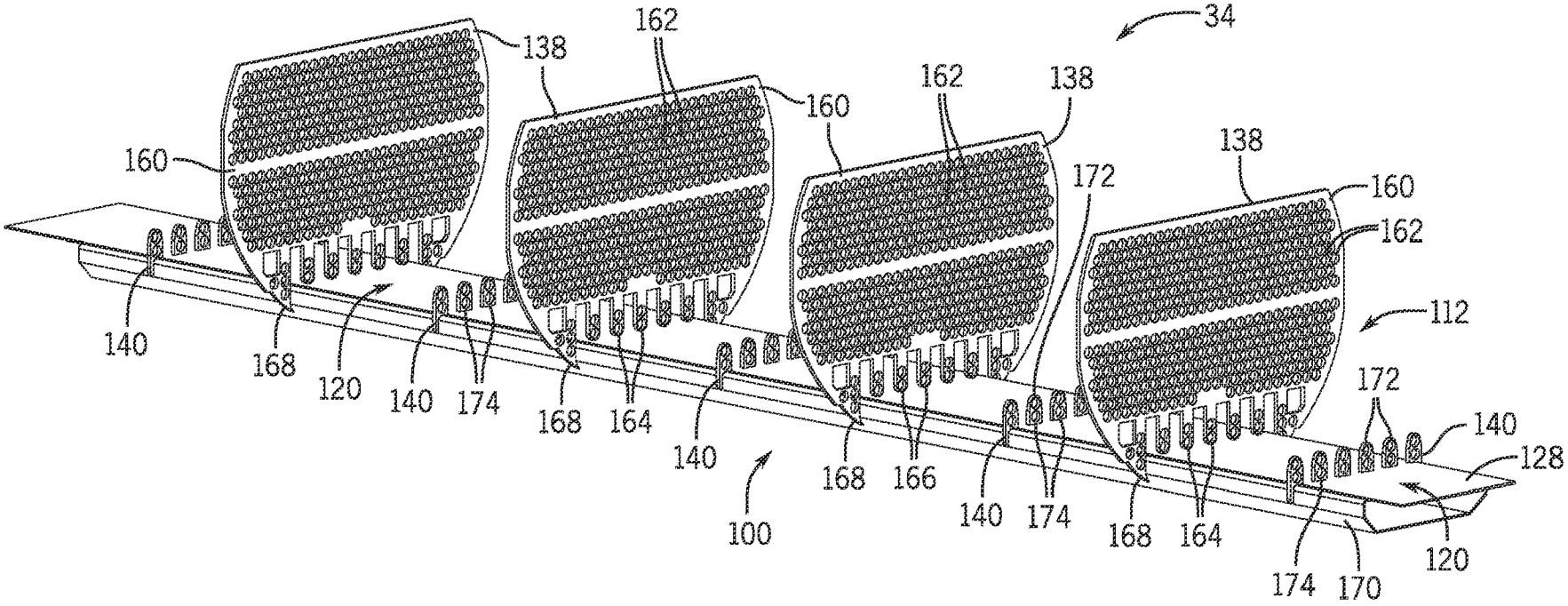
FIG. 7 is a partial perspective view of an embodiment of a condenser having a subcooler, in accordance with an aspect of the present disclosure.
Figure 8:
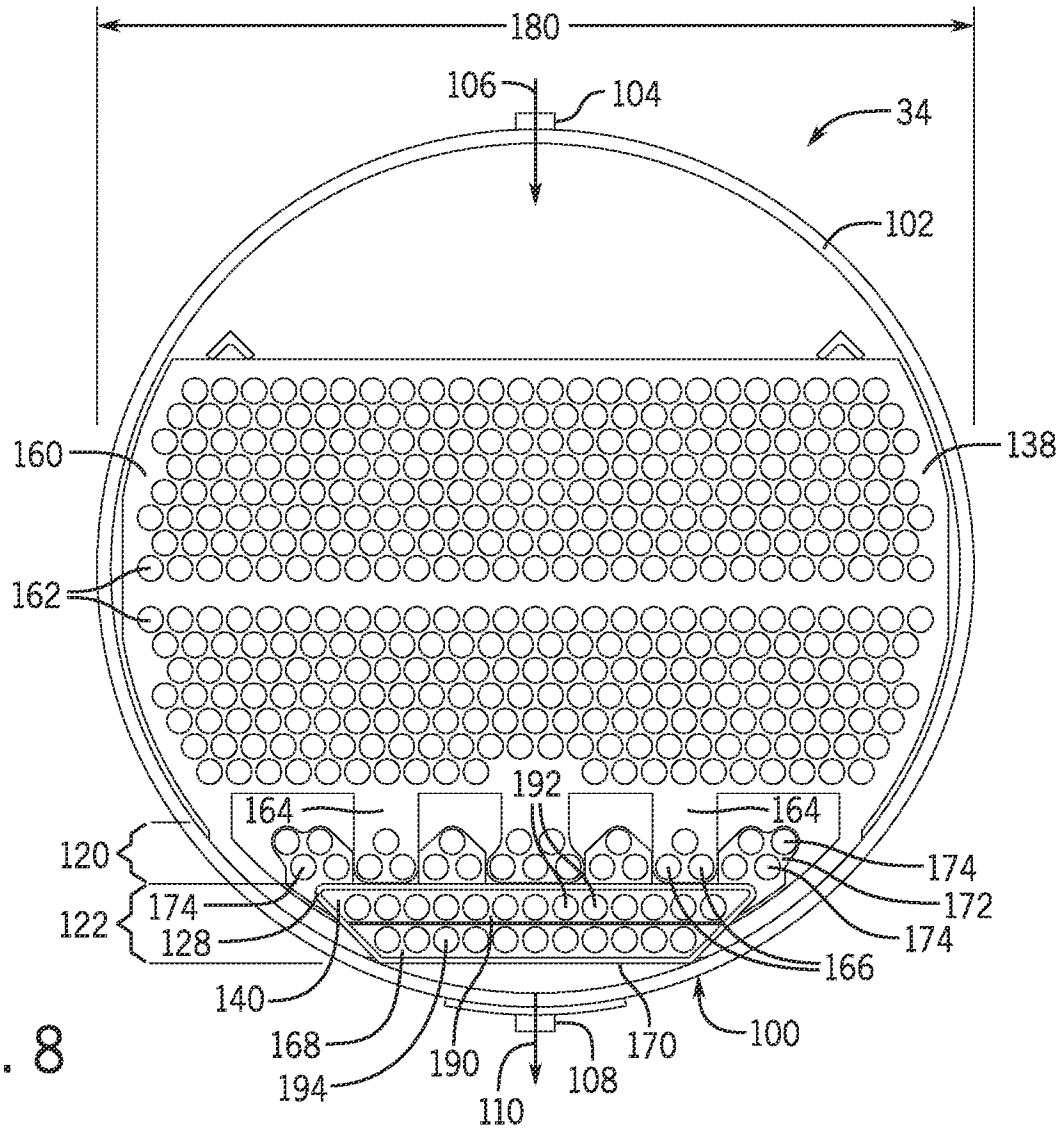
FIG. 8 is a cross-sectional axial view of an embodiment of a condenser having a subcooler, in accordance with an aspect of the present disclosure.
Figure 9:
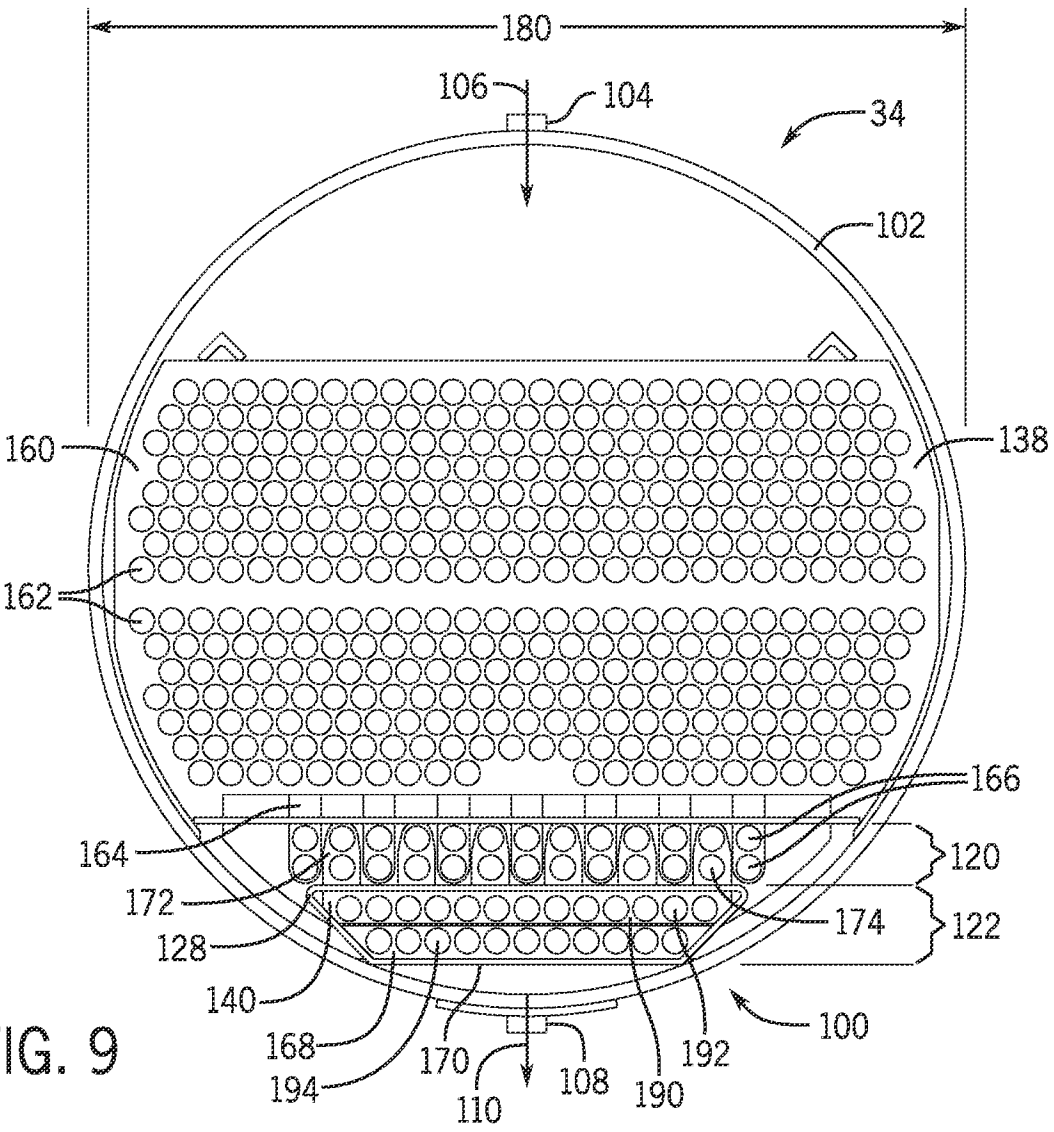
FIG. 9 is a cross-sectional axial view of an embodiment of a condenser having a subcooler, in accordance with an aspect of the present disclosure.

FIG. 7 is a partial perspective view of an embodiment of the condenser 34 having the subcooler 100. In the illustrated embodiment, the shell 102 of the condenser 34 is not shown for clarity purposes. As described above, tube sheets 138 of the condenser 34 support tubes of the tube bundle 114 of the condensing section 112. The tube sheets 138 may also support tubes of the first tube bundle 124 of the first pass 120 of the subcooler 100. For example, each tube sheet 138 includes a main portion 160 having holes 162 (e.g., openings, apertures) configured to support respective tubes of the tube bundle 114 in the condensing section 112. The tube sheets 138 also include baffle portions 164 extending from the main portion 160 toward the separation plate 128. The baffle portions 164 also include holes 166 (e.g., openings, apertures). Each of the holes 166 may support one of the tubes in the first tube bundle 124 or may remain unoccupied by tubes and may instead adjust flow of the refrigerant along the first pass 120 of the subcooler 100, in the manner described above. Each tube sheet 138 also includes a base extension 168 that may extend to and be disposed along the second pass 122 of the subcooler 100. For example, the base extensions 168 may extend through a base portion (e.g., trough) 170 of the subcooler 100, such as through slots formed in the base portion 170. As shown in FIGS. 8 and 9, which are discussed further below, the base extensions 168 also includes holes or apertures configured to accommodate and support tubes of the second tube bundle 126. However, some holes or apertures of the base extensions 168 may remain unoccupied and may instead function to adjust flow of refrigerant along the second pass 122, in the manner described above.

The illustrated embodiment also shows the baffles 140 of the subcooler 100. The baffles 140 are disposed partially along the first pass 120 and partially along the second pass 122 of the subcooler 100. That is, the baffles 140 extend partially within the first pass 120 and the second pass 122. To this end, the baffles 140 extend through the separation plate 128 of the subcooler 100, such as through slots formed in the separation plate 128. For example, each baffle 140 includes baffle extensions 172 that extend through the separation plate 128 and into the first pass 120 of the subcooler 100. Each baffle extension 172 includes holes 174 (e.g., openings, apertures) that may either accommodate a tube of the first tube bundle 124 or may remain unoccupied in order to adjust flow of refrigerant along the first pass 120, such as by increasing a localized velocity of the refrigerant flowing through the first pass 120. The baffles 140 also include base portions disposed along the second pass 122 of the subcooler, which are discussed further below with reference to FIGS. 8 and 9.

In certain embodiments, the tube sheets 138, the baffles 140, the separation plate 128, and/or the base portion 170 may be secured to the shell 102 of the condenser 34 and/or may be secured to one another. For example, one or more of the tube sheets 138, the baffles 140, the separation plate 128, and/or the base portion 170 may be secured to the shell 102 via a weld, braze, adhesive, or other suitable mechanical fastening technique. Each of the tube sheets 138, the baffles 140, the separation plate 128, and/or the base portion 170 may be formed from any suitable material, such as sheet metal, to include a desired geometry or other feature (e.g., holes 162, 166). In some embodiments, a cutting, forming, punching, bending, or other process may be utilized to form the tube sheets 138, the baffles 140, the separation plate 128, and/or the base portion 170.

FIG. 8 is a cross-sectional axial view of an embodiment of the condenser 34 including the subcooler 100, illustrating an arrangement of one of the tube sheets 138 and one of the baffles 140 disposed along the first pass 120 and the second pass 122 of the subcooler 100. The baffle portions 164 of the tube sheet 138 and the baffle extensions 172 of the baffle 140 are disposed within and/or along the first pass 120 of the subcooler 100. In particular, the baffle portions 164 and the baffle extensions 172 are arrayed in an alternating arrangement relative to a width 180 of the condenser 34. The holes 166 of the baffle portions 164 and the holes 174 of the baffle extensions 172 may support tubes of the first tube bundle 124 or remain unoccupied for use in adjusting flow of refrigerant along the first pass 120. In certain embodiments, some of the holes 166 and 174 may accommodate and support tubes of the first tube bundle 124, while other holes 166 and 174 may remain unoccupied by tubes. In other embodiments, the baffles 140 may not include the baffle extensions 172 disposed within the first pass 120. Instead, the first tube bundle 124 within the first pass 120 may be supported by the baffle portions 164 of the tube sheet 138, and refrigerant flow through the first pass 120 may be controlled or adjusted via spaces formed between adjacent baffle portions 164 (e.g., instead of via unoccupied holes 166 and/or 174).

The number of tubes disposed within the holes 166 and 174, the numbers of holes 166 and 174, and/or the shape of the holes 166 and 174 may be selected to achieve one or more desired operating parameters of the condenser 34, such as a target refrigerant liquid volume within the condenser 34, a target refrigerant charge within the condenser 34, a target amount of subcooling of the refrigerant, a target pressure loss of refrigerant, another target operating parameter, or any combination thereof. Indeed, the first tube bundle 124 may include any suitable number of tubes, the baffle portions 164 and baffle extensions 172 may include any suitable number of occupied and unoccupied holes 166 and 174, respectively, and the holes 166 and 174 may have any suitable shape. In some embodiments, holes 166 and 174 accommodating and supporting tubes of the first tube bundle 124 may have a first shape, and holes 166 and 174 remaining unoccupied by tubes of the first tube bundle 124 may have a second shape different than the first shape. For example, the shape of holes 166 and 174 that remain unoccupied by tubes and that are utilized to adjust flow of refrigerant along the first pass 120 may have a shape selected to enable a desired adjustment of the refrigerant flow as the refrigerant flow is directed through the unoccupied holes 166 and 174. Furthermore, in some embodiments, shapes of the baffle portions 164 and baffle extensions 172 may be selected to enable a desired arrangement of the baffle portions 164 and baffle extensions 172 relative to one another and/or to enable a desired arrangement of the tubes of the first tube bundle 124 (e.g., a desired position or height of the first tube bundle 124 within the condenser 34, a desired spacing of the tubes of the first tube bundle 124 relative to one another, a desired spacing between adjacent baffle portions 164 and baffle extensions 172, and so forth). For example, the baffle portions 164 and baffle extensions 172 may be designed and configured to arrange the first tube bundle 124 at a lower height within the condenser 34 relative to existing designs. In this way, a liquid "dead" volume of the condenser 34 (e.g., the subcooler 100) may be reduced.

A configuration of the second pass 122 of the subcooler 100 may be selected based on similar considerations. In the illustrated embodiment, the baffle 140 includes a base portion 190 configured to accommodate a first row of tubes of the second tube bundle 126 of the second pass 122. The base extension 168 of the tube sheet 138 disposed within the second pass 122 is configured to accommodate a second row of tubes of the second tube bundle 126. As mentioned above, the base extension 168 may extend into the second pass 122 via slots formed in the base portion 170 of the subcooler 100. The base portion 170 and the separation plate 128 may be arranged (e.g., couple to one another) to define a volume or channel in which the second tube bundle 126 is disposed and through which refrigerant may flow through the second pass 122 of the subcooler 100. To enable discharge of the refrigerant from the second pass 122 and from the condenser 34, the base portion 170 of the subcooler 100 may have an opening or hole formed therein proximate the outlet 108 of the condenser 34 (e.g., near a midpoint along the length 111 of the condenser 34).

The base portion 190 of the baffle 140 may include any suitable number of holes 192 (e.g., openings, apertures) occupied by tubes of the second tube bundle 126 and any suitable number of holes 192 that are unoccupied by tubes. Similarly, the base extension 168 of the tube sheet 138 may include any suitable number of holes 194 (e.g., openings, apertures) occupied by tubes of the second tube bundle 126 and any suitable number of holes 194 that are unoccupied by tubes. The holes 192 and 194 may have any suitable shape, based on the factors and design considerations discussed above.

FIG. 9 is a cross-sectional axial view of an embodiment of the condenser 34 including the subcooler 100, illustrating another arrangement of the tube sheet 138 and the baffle 140 disposed along the first pass 120 and the second pass 122 of the subcooler 100. The embodiment of FIG. 9 includes similar elements and element numbers as the embodiment shown in FIG. 8. The baffle portions 164 of the tube sheet 138 and the baffle extensions 172 of the baffle 140 are disposed within and/or along the first pass 120 of the subcooler 100, and the base portion 190 of the baffle 140 and the base extension 168 of the tube sheet 138 are disposed within and/or along the second pass 122. In the illustrated embodiment, the baffle portions 164 of the tube sheet 138 and the baffle extensions 172 of the baffle 140 are also disposed in an alternating arrangement relative to the width 180 of the condenser 34. In the illustrated embodiment of FIG. 8, the baffle portions 164 include holes 166 arranged in a staggered or offset arrangement (e.g., a pitched arrangement), and the baffle extensions 172 include holes 174 arranged in a staggered or offset arrangement. In the illustrated embodiment of FIG. 9, the holes 166 of each baffle portion 164 and the holes 174 of each baffle extension 172 are arranged in a linear (e.g., vertical) arrangement. Indeed, in the illustrated embodiment of FIG. 9, the baffle portions 164 and the baffle extensions 172 each have a generally vertical or linear configuration, and the baffle portions 164 and baffle extensions 172 are alternatingly arranged along the width 180 of the condenser 180. In other embodiments, the baffle portions 164 and the baffle extensions 172 may each extend at angle relative to a vertical axis.

The subcooler embodiments and configurations described herein may be manufactured, assembled, and otherwise produced in a cost effective manner while enabling desirable subcooling of refrigerant in the condenser. For example, the tube sheets, baffles, separation plate, and other components may be readily manufactured from materials such as sheet metal and may be assembled more conveniently and efficiently than existing subcooler designs while still enabling efficient subcooling of refrigerant within the condenser. As described above, the subcooler includes a first pass configured to receive refrigerant from a condensing section and a second pass configured to receive refrigerant from the first pass. The arrangement of the tube sheets and the baffles enables improved refrigerant flow through the first pass and the second pass, while also enabling improved subcooling of the refrigerant therein. In the manner described above, the subcooler configurations disclosed herein enable a reduction in refrigerant charge within the condenser and improved subcooling via increased contact between cooling fluid tubes and liquid, condensed refrigerant within the condenser and subcooler.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A condenser, comprising:

a shell defining an inner volume configured to receive and discharge a refrigerant;

a condensing section disposed within the shell, wherein the condensing section comprises a plurality of tubes configured to circulate cooling fluid therethrough;

a subcooler disposed within the shell and configured to receive the refrigerant from the condensing section, comprising:

a first pass comprising a first set of tubes configured to circulate cooling fluid therethrough;

a second pass comprising a second set of tubes configured to circulate cooling fluid therethrough, wherein the second pass is disposed downstream of the first pass relative to a flow of refrigerant through the subcooler; and a separation plate disposed between the first set of tubes and the second set of tubes; and a baffle disposed within the shell, wherein the baffle comprises:

a base portion disposed within the second pass and configured to support the second set of tubes; and baffle extensions extending from the base portion, wherein the baffle extensions are disposed within the first pass and are configured to support the first set of tubes.

2. The condenser of claim 1, wherein the baffle extensions comprise a first plurality of apertures configured to receive the first set of tubes, and wherein at least one aperture of the first plurality of apertures is unoccupied by the first set of tubes.

3. The condenser of claim 2, wherein the base portion comprises a second plurality of apertures configured to receive the second set of tubes, and wherein at least one aperture of the second plurality of apertures is unoccupied by the second set of tubes.

4. The condenser of claim 1, wherein the baffle extensions extend from the base portion, through the separation plate, and into the first pass.

5. The condenser of claim 1, comprising a tube sheet disposed within the shell, wherein the tube sheet comprises a main portion configured to support the plurality of tubes, and the tube sheet comprises baffle portions extending from the main portion, wherein the baffle portions are disposed within the first pass.

6. The condenser of claim 5, wherein the baffle portions are configured to support the first set of tubes.

7. The condenser of claim 6, wherein the baffle portions comprise a plurality of apertures configured to receive the first set of tubes, and wherein at least one aperture of the plurality of apertures is unoccupied by the first set of tubes.

8. The condenser of claim 5, wherein the tube sheet comprises a base extension extending from the main portion, wherein the base extension is disposed within the second pass and is configured to support the second set of tubes.

9. The condenser of claim 8, wherein the base extension comprises a plurality of apertures configured to receive the second set of tubes, and wherein at least one aperture of the plurality of apertures is unoccupied by the second set of tubes.

10. A condenser for a heating, ventilation, air conditioning, and refrigeration (HVAC&R) system, comprising:

a shell configured to receive vapor refrigerant;

a condensing section disposed within the shell, wherein the condensing section comprises a plurality of tubes configured to circulate cooling fluid therethrough, and the condensing section is configured to condense the vapor refrigerant to form liquid refrigerant; and a subcooler disposed within the shell downstream of the condensing section relative to refrigerant flow through the condenser, wherein the subcooler comprises:

a first pass configured to receive the liquid refrigerant from the condensing section;

a second pass configured to receive the liquid refrigerant from the first pass;

a separation plate extending along a length of the condenser, wherein the separation plate divides the first pass and the second pass, and the separation plate is configured to direct the liquid refrigerant along the first pass to the second pass; and a baffle, wherein the baffle comprises:

a base portion disposed within the second pass and configured to support tubes of the second pass; and baffle extensions extending from the base portion and disposed within the first pass, wherein the baffle extensions extend through the separation plate and are configured to support tubes of the first pass.

11. The condenser of claim 10, wherein the first pass is exposed to the condensing section.

12. The condenser of claim 10, wherein the tubes of the first pass comprise a first set of tubes configured to circulate cooling fluid therethrough, the tubes of the second pass comprise a second set of tubes configured to circulate cooling fluid therethrough, and the separation plate extends between the first set of tubes and the second set of tubes.

13. The condenser of claim 12, wherein the base portion comprises a first aperture unoccupied by the second set of tubes, the baffle extensions comprise a second aperture unoccupied by the first set of tubes, or both.

14. The condenser of claim 12, comprising a tube sheet disposed within the shell, wherein the tube sheet comprises:

a main portion disposed within the condensing section and configured to support the plurality of tubes; and baffle portions extending from the main portion, wherein the baffle portions are disposed within the first pass, and the baffle portions are configured to support the first set of tubes.

15. The condenser of claim 12, comprising end panels disposed within the shell, wherein each end panel extends from a respective longitudinal end of the shell and along the length of the condenser, wherein the end panels are disposed below the plurality of tubes and above the first set of tubes.

16. A condenser for a heating, ventilation, air conditioning, and refrigeration (HVAC&R) system, comprising:

a shell configured to receive and discharge a refrigerant;

a plurality of tubes disposed within the shell and configured to place the refrigerant in a heat exchange relationship with cooling fluid directed through the plurality of tubes to condense the refrigerant; and a subcooler disposed within the shell, wherein the subcooler comprises:

a first pass comprising a first set of tubes disposed beneath the plurality of tubes and configured to direct cooling fluid therethrough;

a second pass comprising a second set of tubes disposed beneath the first set of tubes and configured to direct cooling fluid therethrough;

a separation plate disposed between the first set of tubes and the second set of tubes to divide the first pass and the second pass; and a baffle disposed within the second pass, wherein the baffle comprises:

a base portion disposed within the second pass and configured to support the second set of tubes; and baffle extensions extending from the base portion, wherein the baffle extensions are disposed within the first pass and are configured to support the first set of tubes.

17. The condenser of claim 16, wherein the baffle extensions extend through the separation plate.

18. The condenser of claim 16, comprising a tube sheet disposed within the shell, wherein the tube sheet comprises:

a main portion configured to support the plurality of tubes; and baffle portions extending from the main portion, wherein the baffle portions are disposed within the first pass, the baffle portions are configured to support the first set of tubes, and the baffle portions and the baffle extensions are disposed in an alternating arrangement relative to a width of the condenser.

19. A condenser, comprising:

a shell defining an inner volume configured to receive and discharge a refrigerant;

a condensing section disposed within the shell, wherein the condensing section comprises a plurality of tubes configured to circulate cooling fluid therethrough;

a subcooler disposed within the shell and configured to receive the refrigerant from the condensing section, comprising:

a first pass comprising a first set of tubes configured to circulate cooling fluid therethrough;

a second pass comprising a second set of tubes configured to circulate cooling fluid therethrough, wherein the second pass is disposed downstream of the first pass relative to a flow of refrigerant through the subcooler; and a separation plate disposed between the first set of tubes and the second set of tubes; and a tube sheet disposed within the shell, wherein the tube sheet comprises:

a main portion configured to support the plurality of tubes; and baffle portions extending from the main portion, wherein the baffle portions are disposed within the first pass.

20. A condenser for a heating, ventilation, air conditioning, and refrigeration (HVAC&R) system, comprising:

a shell configured to receive vapor refrigerant;

a condensing section disposed within the shell, wherein the condensing section comprises a plurality of tubes configured to circulate cooling fluid therethrough, and the condensing section is configured to condense the vapor refrigerant to form liquid refrigerant;

a subcooler disposed within the shell downstream of the condensing section relative to refrigerant flow through the condenser, wherein the subcooler comprises:

a first pass configured to receive the liquid refrigerant from the condensing section;

a second pass configured to receive the liquid refrigerant from the first pass; and a separation plate extending along a length of the condenser, wherein the separation plate divides the first pass and the second pass, and the separation plate is configured to direct the liquid refrigerant along the first pass to the second pass; and one or more end panels disposed within the shell, wherein each end panel of the one or more end panels extends from a respective longitudinal end of the shell and along the length of the condenser, wherein the one or more end panels are disposed below the plurality of tubes and above tubes of the first pass relative to gravity.

* * * * *